United States Patent [19]

Fekete et al.

[11] 3,980,752

[45] Sept. 14, 1976

[54] PRECIPITATION OF NICKEL, COBALT, LEAD SULPHIDES IN PRESENCE OF IRON OXIDES OR HYDROXIDES

[75] Inventors: Simon Otto Fekete, Falconbridge; Quentin Reginald Chapman, Toronto; Lynn Shapley Price, Weston, all of Canada

[73] Assignee: Falconbridge Nickel Mines Limited, Toronto, Canada

[22] Filed: Dec. 9, 1974

[21] Appl. No.: 530,571

Related U.S. Application Data

[62] Division of Ser. No. 278,322, Aug. 7, 1972, abandoned.

[30] Foreign Application Priority Data

Sept. 2, 1971 United Kingdom ..... 42021/71

[52] U.S. Cl. ..... 423/92; 423/140; 423/144

[51] Int. Cl.[2] ..... C01G 21/00; C01G 51/00; C01G 53/00

[58] Field of Search ..... 423/140, 141, 142, 144, 423/150, 92, 561

[56] References Cited

UNITED STATES PATENTS

| | | | |
|---|---|---|---|
| 1,793,906 | 2/1931 | Christensen | 423/92 X |
| 2,296,423 | 9/1942 | Clark | 423/141 |
| 2,872,306 | 2/1959 | Morrow | 75/108 |
| 2,939,767 | 6/1960 | Martin | 423/633 |
| 3,549,321 | 12/1970 | Everett | 423/140 |

OTHER PUBLICATIONS

*Chemical Abstracts* vol. 69, 1968 No. 100048q.

*Primary Examiner*—Oscar R. Vertiz
*Assistant Examiner*—Brian E. Hearn
*Attorney, Agent, or Firm*—Richard J. Hicks

[57] ABSTRACT

A hydrometallurgical process for separating iron and nickel contained in iron and nickel-bearing sulphide materials, comprising selective leaching of iron with respect to nickel with hydrochloric or other mineral acid to provide a leach solution and leached solids. The nickel contained in the leach solution is separated from the dissolved iron as nickel sulphide by precipitation with hydrogen sulphide in the presence of an iron-bearing substance in which the iron is present in a form selected from the group comprising oxides, hydroxides and combinations thereof.

7 Claims, 2 Drawing Figures

PRECIPITATION OF NICKEL, COBALT, LEAD SULPHIDES IN PRESENCE OF IRON OXIDES OR HYDROXIDES

This is a division of application Ser. No. 278,322, filed Aug. 7, 1972, now abandoned.

The present invention relates to the separation of iron and nickel contained in iron and nickel-bearing sulphide materials by acid leaching and solution purification.

Hydrochloric acid leaching of iron-bearing sulphides is known in the art. In U.S. Pat. No. 1,897,921, for example, a process is described in which iron sulphide is treated with slightly more hydrochloric acid than that theoretically required to dissolve the iron, thereby forming an essentiaally ferrous chloride solution containing non-ferrous metal chlorides as impurities, and a rather impure iron oxide is produced by evaporation.

In Canadian Pat. No. 844,536 hydrochloric acid is similarly used to dissolve substantially all the iron from iron sulphide containing a small quantity of non-ferrous metals; in this case, however, the acidity of the final leach solution is controlled at a pH of between 1.5 and 4 and no non-ferrous metals are dissolved, but while the latter leaching process may be used to dissolve iron from iron sulphide materials containing minor quantities of non-ferrous metals, it has not been found possible to apply it successfully to iron-bearing sulphide materials which contain substantial amounts of non-ferrous metals, such as mattes produced by smelting, because not only is leaching exceedingly slow at the low acidities taught but it is also impossible to effect substantially complete iron separation and to prevent non-ferrous metal dissolution.

There are also numerous processes described in the art for the separation of non-ferrous metals dissolved in aqueous solutions, such as might be generated by leaching an iron and nickel-bearing sulphide material according to the leaching process of the present invention; however, they all suffer from certain disadvantages. For example, metallic nickel can be cemented from aqueous solutions using iron scrap but the product is generally contaminated not only with iron but with other impurities in the scrap and using purer or more active forms of metallic iron is generally not attractive economically.

Other processes which have been developed depend upon the precipitation from solution of nickel sulphide. For example, in U.S. Pat. No. 2,722,480, the pH of an aqueous solution containing dissolved nickel and cobalt is controlled to below a value of 3, to prevent hydroxide formation, and the partial pressure of hydrogen sulphide is raised above atmospheric to precipitate nickel and cobalt as sulphides. Similarly in the high pressure process for sulphide precipitation described in U.S. Pat. No. 2,662,009 certain non-ferrous metals are precipitated as sulphides in stages from an aqueous solution at high temperatures, about 450°F, by adding iron sulphide in an amount which is just sufficient for the iron contained therein to replace the particular non-ferrous metal in solution which it is desired to precipitate. Such processes have, however, inherent disadvantages due to their high operating temperatures and pressures.

An object of the present invention is to provide a controlled leaching process in which iron is selectively leached with respect to nickel from iron and nickel-bearing particulate materials to produce an acid leach solution and leached solids.

Another object of the present invention is to provide a process for substantially completely precipitating nickel from the iron-containing acid leach solution.

For the purpose of the present disclosure leaching selectivity is defined as follows:

% Fe dissolved/% Ni dissolved, and a selective leaching process is, therefore, one in which the above ratio is greater than unity.

By one aspect of the present invention there is provided a process in which a nickel and iron-bearing sulphide material is treated with a mineral acid, preferably hydrochloric acid, so as to selectively leach iron with respect to nickel and produce a leach slurry comprising an acid leach solution containing a major proportion of the iron and a minor proportion of the nickel contained in the sulphide material.

It has been found that the selectivity of the leaching process for iron with respect to nickel can be controlled by adjusting the acid consumption per unit mass of sulphide material and the acidity of the leach slurry product withdrawn from the leaching process. Thus, under conditions of constant acid consumption, the leaching selectivity can be increased by reducing the acidity of the leach slurry, thereby increasing the proportion of iron dissolved and decreasing the proportion of nickel dissoled. Conversely, the leaching selectivity can be decreased by raising the acidity of the leach slurry. While it is possible, by adjusting acid consumption and acidity of the leach slurry, to dissolve essentially any proportion of iron and nickel and thereby achieve a wide range of leaching selectivities, it is a preferred object to dissolved substantially all iron from the sulphide material and to limit the dissolution of nickel, thereby achieving high leaching selectivities.

By another aspect of the invention, there is provided a process for recovering nickel from an acid solution. Usually, but not essentially, the acid solution is the mineral acid, preferably hydrochloric acid, solution produced in the selective leaching process described hereinabove. Surprisingly, it has been found that the dissolved nickel in the solution can be substantially completely precipitated with hydrogen sulphide, without recourse to high temperatures and pressures, in the presence of a particulate iron bearing material in which the iron is present in a form selected from the group consisting of oxides, hydroxides and mixtures thereof.

Advantageously, it is also possible to precipitate not only nickel by the above-stated means but other dissolved non-ferrous metals such as lead and cobalt, thereby generating substantially pure iron salt solutions suitable for acid recovery by well-known methods.

The present invention will be more clearly understood by reference to the following drawings.

Figure 1:
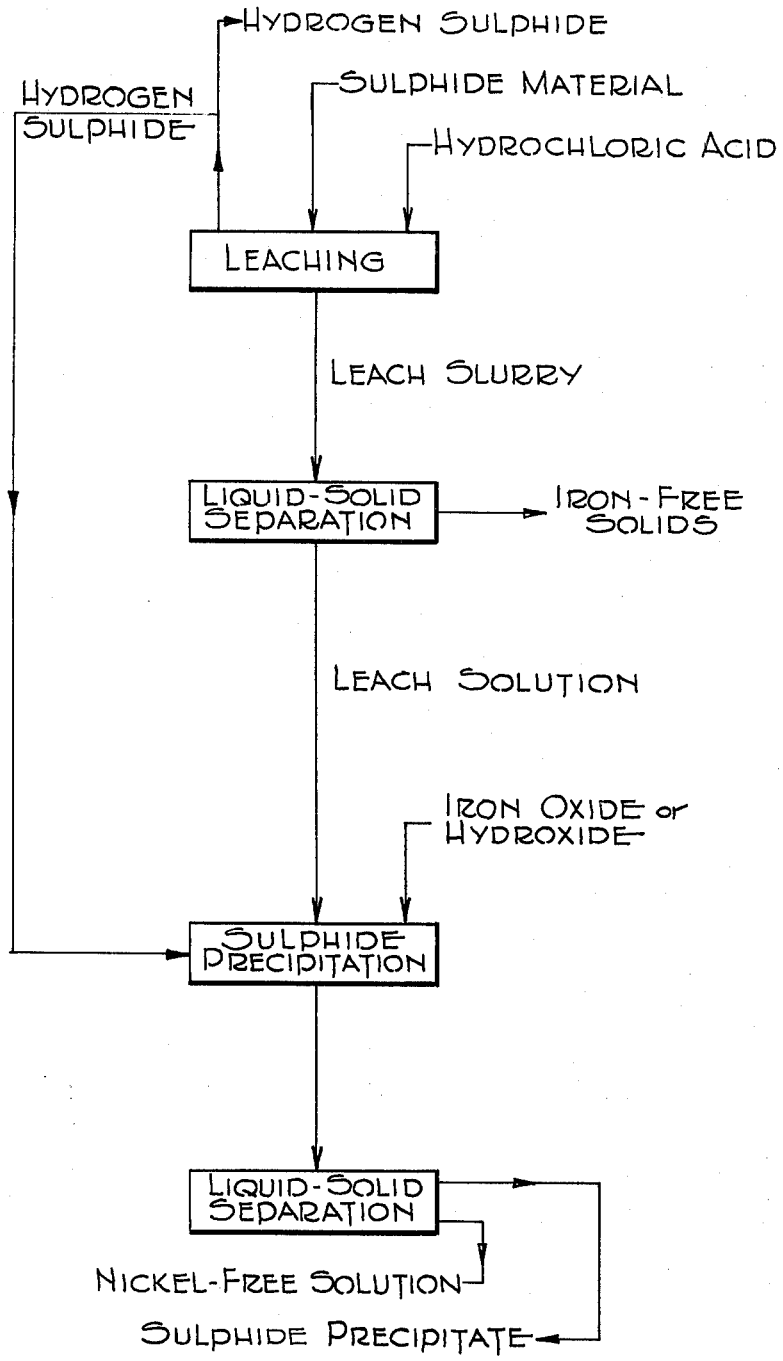
FIG. 1 is a schematic representation of a preferred embodiment of the present invention showing the leaching and precipitation steps.

FIG. 1 illustrates a preferred embodiment of the present invention by which substantially complete separation of iron and nickel contained in iron and nickel-bearing sulphide material can be accomplished. In summary, the sulphide material is first leached with hydrochloric acid to selectively leach iron and produce substantially iron-free leached solids and an iron chloride leach solution containing only a minor quantity of nickel. The leach solution is then treated with hydrogen sulphide in the presence of an iron-bearing material, in which the iron is present in a form selected from the group comprising oxides and hydroxides and combinations thereof, to precipitate nickel sulphide and to generate a substantially nickel-free iron chloride solution.

It will be appreciated that although the present discussion describes the use of hydrochloric acid as the preferred acid, other mineral acids may also be used.

The leaching step can be carried out in any preferred or convenient manner; however, for treating large quantities of material, a continuous leaching process is most suitable. A convenient process is that provided by multi-stage cocurrent leaching. In this process, sulphide material and hydrochloric acid are continuously admitted to a leaching system comprising a number of interconnected tanks. Slurry passes from tank to tank until a final leach slurry is generated, withdrawn from the system and separated into an acidic aqueous leach solution and leached solids.

Regardless of the particular leaching system used, it has been found possible to control the selectivity of leaching of iron with respect to nickel by varying the acid consumption per unit mass of material and the acidity of the final leach slurry generated in the leaching system. Accordingly, if the acid consumption is maintained constant, the selectivity can be increased by lowering the acidity of the final leach slurry and conversely decreased by raising the acidity.

Although it is possible, by adjusting the acid consumption and the acidity of the final leach slurry, to achieve a wide range of leaching selectivities and iron dissolutions, it is the preferred aim of the leaching step to dissolve substantially all iron from the sulphide material and only a minor quantity of the nickel. It would be highly desirable if an iron and nickel-bearing sulphide material could be leached with hydrochloric acid so that all iron and no nickel was dissolved; in practice, however, it is found that not only is it impossible to dissolve all of the iron but that some nickel is also unavoidably dissolved. For example, to maintain a constant high iron dissolution of the order of 96%, and at the same time increase the leaching selectivity by lowering the proportion of nickel dissolved, the acid consumption and the acidity of the final leach slurry must be reduced simultaneously. Controlling the leaching parameters in this way is limited in practice because, as the acidity of the leach slurry is reduced, the time necessary to achieve the desired leaching results rises and eventually the process becomes impractical. Thus, it is necessary to compromise between acidity and leaching selectivity and, in general, it has been found that the acidity of the leach slurry withdrawn from the system should be maintained above that represented by a pH of 1.

Control of acid consumption and final leach slurry acidity is normally effected by adjusting the relative flow rates of acid, solids and water to the leaching system. However, alternative methods, while they are, generally, not as convenient, can be used and these are usually related to the design of the leaching system and for example, may incorporate the application of multi-tank feeding of reactants or the use of mechanical features such as by-pass streams or tank volume limiting devices.

While a preferred object of the present leaching step is to leach substantially all the iron from the sulphide material, it will be appreciated that the precise proportion of iron to be dissolved can be freely controlled in relation to the requirements of subsequent processes for the treatment of the remaining nickel sulphide-bearing leached solids.

The combination of acid consumption and acidity which must be used to achieve a specific leaching result is closely related to the type of sulphide material being leached. It has been found that iron and nickel-bearing sulphide materials best suited to the leaching treatment are those which have undergone some form of activation, such as smelting, and up to about 99% iron dissolution can be achieved by leaching such mattes. Selective leaching of sulphide ores in the form of, for example, flotation concentrates, can be carried out, but it is generally found that high iron dissolutions are accompanied by a relatively high solubility of nickel and that relatively low leaching selectivities are achieved.

The rate at which leaching progresses is related to the particle size of the sulphide material and to the efficiency of agitation of the leach slurry during leaching. A fine particle size increases the leaching rate but in most cases a preferred size can only be determined by considering the grindability and reactivity of the material. In general, however, the material should have an average particle size in the range of about $37\mu$ to about $250\mu$ (400 – 60 Tyler Mesh). With respect to agitation, this should be at least sufficient to maintain a homogeneous slurry and to prevent settling which causes incomplete and inefficient leaching.

The sulphide material can be admitted to the leaching system either dry or as an aqueous slurry, and the hydrochloric acid can be of any convenient strength. In practice, however, it is preferable to limit dilution of the leaching system so as to reduce the total leaching volume and, more importantly, to produce a more concentrated chloride leach solution suitable for treatment to regenerate hydrochloric acid for recycling to the leaching step by means such as that described in U.S. Pat. No. 3,642,441. Thus, the treatment of an 8N chloride leach solution containing about 224 g/L dissolved iron is much preferred to the treatment of a 2N chloride solution containing only about 56 g/L dissolved iron. In general, therefore, the leaching process is conducted so as to generate a leach solution containing at least 100 g/L dissolved iron.

A particular advantage of the present invention is that the leaching process is performed at ambient pressure and at temperatures below the boiling point of the leach slurry. The hydrochloric acid and sulphide material react exothermically and, in some cases, the required leaching temperature can be maintained merely by using adequate insulation. Where the heat generated by the chemical reactions is insufficient to maintain the desired temperature heat can be conveniently supplied by, for example, steam coils within the tank and in direct contact with the leach slurry. In general, it has been found that leaching temperatures between ambient and the boiling point of the solutions are satisfactory.

Leaching of the sulphide material is accompanied by the production of hydrogen sulphide and, possibly, depending upon the presence of metallics, some hydrogen. The hydrogen sulphide can be recirculated, if desired, to the leaching system, particularly to leach tanks operating at low acidity, to suppress nickel dissolution and is also useful in the subsequent purification step of the present invention which involves sulphide precipitation as described more fully hereinafter. The hydrogen sulphide can, of course, also be treated by established methods for sulphur recovery.

The amount of nickel dissolved with the iron from the sulphide material during leaching depends upon the specific leaching conditions and it is one object of the second stage of the present invention to provide a means for its recovery.

It has been found that dissolved nickel can be precipitated from dilute acidic aqueous solutions, such as are generated by the leaching step of the present invention, as nickel sulphide by treatment with hydrogen sulphide in the presence of an iron-bearing substance in which the iron is present in a form selected from the group comprising oxides and hydroxides and combinations thereof.

When sulphides are precipitated from aqueous solution under the action of hydrogen sulphide, acid is generated. For example, in the case of the precipitation of nickel from a chloride solution, the reaction can be expressed as follows:

$$NiCl_2 + H_2S = NiS + HCl$$

The formation of acid tends to inhibit precipitation and, if generated in sufficient quantity, may stop the reaction, unless, as it is generated, it is consumed in some way. The fact that iron-bearing materials, in which the iron is present in a form selected from the group comprising oxides and hydroxides or combinations thereof, have the ability to consume the acid generated, and therefore allow the precipitation reaction to progress, is a very surprising result, since these materials are generally considered to be substantially inert in dilute acid. The reaction mechanisms involved are uncertain, but the method is extremely successful and substantially all nickel can be precipitated from the leach solution to levels as low as 0.01 g/L.

A particular advantage of the process is the surprisingly economic use of the iron-bearing materials. It has been found, for example, that substantially no excess iron is needed beyond that required stoichiometrically to react with the acid generated by sulphide precipitation and, depending upon the initial acidity of the aqueous solution, free acid in the leach solution. Thus, as a result, a further considerable advantage of the present process is that a sulphide precipitate can, if desired, be recovered which contains only a small quantity of iron, for example, less than 2%. In addition, since acid is replaced by iron, solutions already containing iron, such as the leach solutions generated in the leaching stage of the present invention, are not contaminated, which would be the case if other neutralizing agents, such as caustics, were used.

There are many iron oxide and hydroxide materials which can be used in the present process and these range from the substantially pure to iron materials in which the oxide and hydroxide are present only as constituents. Thus, in the present process, substantially pure iron oxides, for example, produced by hydrolyzing iron chloride solutions or briquettes formed from iron chloride crystals, have been used successfully; also, ferric hydroxide and ferrous hydroxide and the oxide produced from the roasting of iron sulphide have been used, as has material produced by the roasting of iron-copper-nickel sulphide flotation concentrates which contain, for example, only about 40% of iron compared to the 70% contained in ferric oxide, $Fe_2O_3$.

Figure 2:
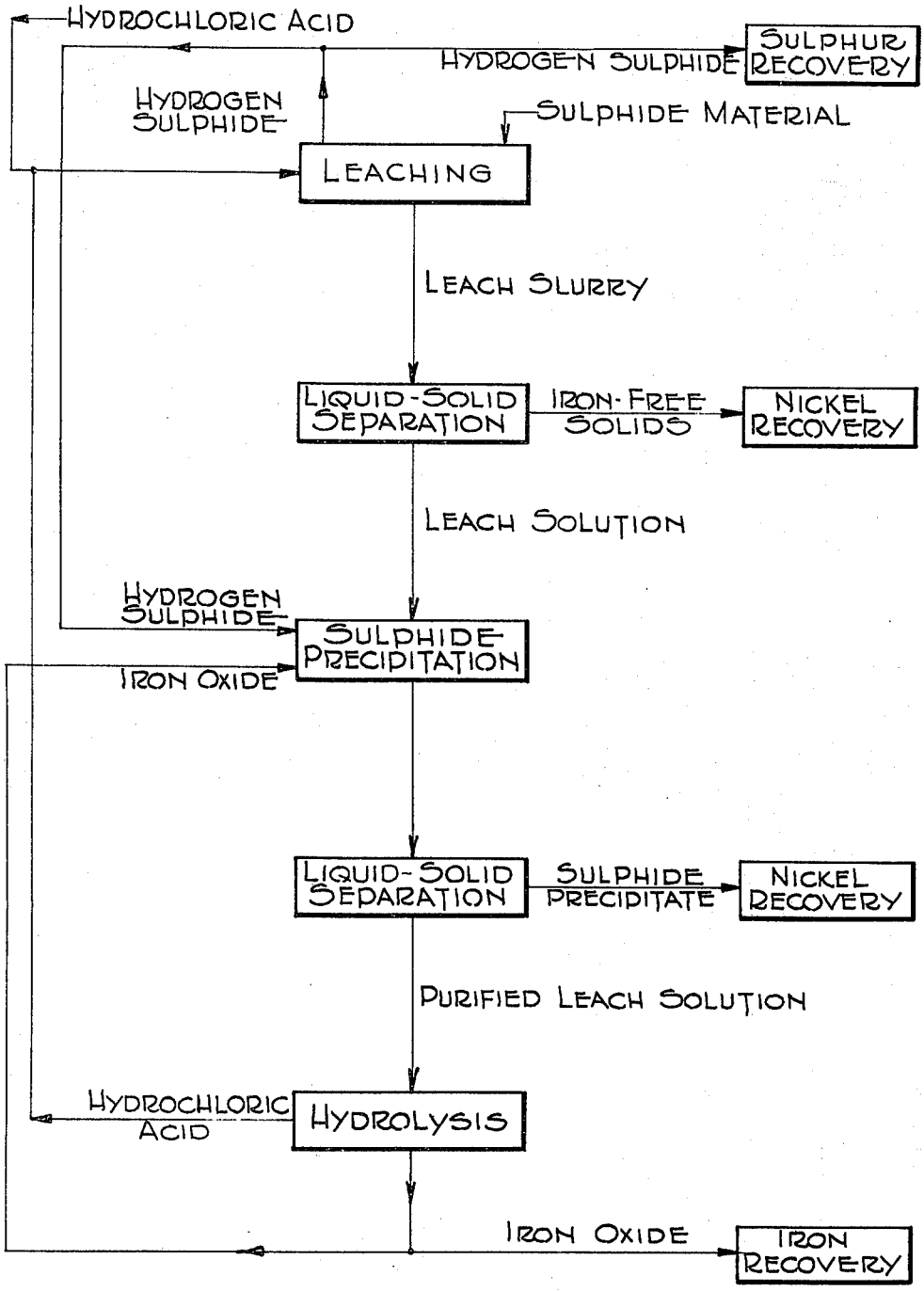
FIG. 2 is a schematic representation of a particular embodiment of the invention in which a purified leach solution, essentially iron chloride, is treated to recover hydrochloric acid for leaching and iron oxide for sulphide precipitation.

A further advantage of the present process is that other non-ferrous metals, apart from nickel, can be substantially completely precipitated. For example, in the hydrochloric acid leaching of iron and nickel-bearing sulphide materials, as previously described, the leach solution separated from the final leach slurry withdrawn from the leaching system often contains small quantities of cobalt and lead both of which should, desirably, be recovered. It has been found that, by the present process, not only is substantially all nickel precipitated but also cobalt and lead, and this results in the formation of an almost pure ferrous chloride solution suitable for the regeneration of hydrochloric acid and the production of a highly pure iron oxide by well established means, such as that disclosed in U.S. Pat. No. 3,642,441. The regenerated acid can, as previously described, be used in the leaching step and the iron oxide generated used in the leach solution purification step. Thus, there results from the combination of the leaching step, the leach solution purification step and the hydrochloric acid recovery step, a highly advantageous hydrometallurgical process for the separation and recovery of nickel and such a process is outlined schematically in FIG. 2.

In a particular, preferred embodiment of the present process, the iron-bearing material used is ferrous hydroxide which is generated within the leach solution prior to treatment with hydrogen sulphide by reacting iron dissolved therein with ammonium hydroxide. Since the ferrous hydroxide is freshly precipitated, it is extremely active and consumes the acid generated during subsequent sulphide precipitation rapidly and the precipitation reactions proceed quickly to completion.

As is the case in the leaching step, the purification step can conveniently be performed in any suitable reaction vessel, at ambient pressures and at temperatures below the boiling point of the leach solution. High temperature favours the rate of sulphide precipitation and, preferably, though not necessarily, temperatures above about 50°C should be used. The precipitation rate also increases as the particle size of the iron bearing material becomes smaller and is assisted by efficient agitation. In general the material should have an average particle size in the range of about 37$\mu$ to about 250$\mu$ but the preferred size can only be determined by considering factors such as reactivity and, if necessary, grindability.

While the purification stage of the present invention is advantageously used for the treatment of leach solutions generated by the hydrochloric or other mineral acid leaching of iron and nickel-bearing sulphide materials, it can similarly be applied to the purification of acidic aqueous solutions containing non-ferrous metals from other sources including such solutions as sulphate solutions.

During non-ferrous metal precipitation, the aqueous acidic solution should, preferably, be saturated with hydrogen sulphide and a sufficient quantity of the gas should be admitted to the purification stage for this purpose. The hydrogen sulphide can be provided from any convenient source; in an integrated leaching and purification process, however, it is very readily available as a product of the sulphide leaching reactions.

The present invention will be more easily understood with reference to the following examples. It is to be understood, however, that these examples only typify the present invention and are not to be regarded as limiting in any way.

EXAMPLE 1

A matte having an analysis of 13.5% nickel, 47.3% iron, and 9.07% copper, and an average particle size of about 44$\mu$, was slurried with water in the proportion of 50 g of matte to 61 ml of water and fed, with 8.3N hydrochloric acid solution, to the first tank of a three tank cocurrent leaching system. Each tank had a working volume of 11 liters. The feed rate of the slurry, approximately 50 g matte per minute, and that of the acid solution, approximately 101 ml per minute, were adjusted to control the acid consumption per unit mass of matte and the acidity of the final leach slurry contained in and withdrawn from the third leaching tank. Each tank was fitted with an agitation device and the leaching temperature was maintained at 70°C. The results of two leaching tests are given in Table 1.

TABLE 1

| | Final Solution Analysis | | | % Dissolution | | Selectivity % Fe Dissolved / % Ni Dissolved |
|---|---|---|---|---|---|---|
| | g/L Ni | g/L Fe | g/L HCl | Fe | Ni | |
| Test 1 | 4.3 | 130 | 6.6 | 89.1 | 11.0 | 8.1 |
| Test 2 | 1.7 | 134 | 4.4 | 91.6 | 4.7 | 21.8 |

The two tests demonstrate that lowering the acidity of the final leach slurry at a substantially constant acid consumption (represented approximately by the sum of the iron and nickel concentrations in solution) increases the leaching selectivity. The tests also show that some nickel is dissolved at low acidity, even though there is a substantial amount of iron remaining in the leached material.

EXAMPLE 2

Two leaching tests were conducted using a matte having an analysis of 18.6% nickel, 36.9% iron and 15.3% copper and an average particle size of about 44$\mu$. In Test 1 the matte was slurried with water in the proportion of 50 g of material to 61 ml water, and fed with 8.2N hydrochloric acid solution to a single leaching tank. The feed rate of matte was 50 g per minute and that of acid solution was 80 ml per minute. Feeding was continued for 75 minutes and a sample of slurry removed from analysis after a further 130 minutes. In Test 2 the matte was slurried with water in the proportion of 44 g matte to 61 ml water and fed with 8.15N hydrochloric acid solution to a single leaching tank. The feed rate of matte was 44 g per minute and that of acid solution 75 ml per minute. Feeding was continued for 67 minutes and a sample of slurry removed for analysis after a further 143 minutes. Each test was conducted at a temperature of 70°C and efficient slurry agitation was maintained. The results of the tests are shown in Table 2.

TABLE 2

| | Final Solution Analysis | | | % Dissolution | | Selectivity % Fe Dissolved / % Ni Dissolved |
|---|---|---|---|---|---|---|
| | g/L Ni | g/L Fe | g/L HCl | Fe | Ni | |
| Test 1 | 5.5 | 118 | 7.9 | 90.6 | 8.3 | 10.9 |
| Test 2 | 9.1 | 112 | 7.7 | 94.7 | 15.3 | 6.2 |

The tests demonstrate that at a substantially constant acidity raising the acid consumption (represented approximately by the sum of the iron and nickel concentrations in solution) reduces the leaching selectivity, although a higher iron dissolution is achieved.

EXAMPLE 3

A matte having an analysis of 17.2% nickel, 39.3% iron and 14.5% copper and a particle size of 100% less than 149$\mu$, was slurried with water in the proportion of 50 g matte to 46 ml water and fed continuously to a leaching tank at a rate of 50 g matte per minute with 9.9N hydrochloric acid solution at a rate of 71 ml per minute for 100 minutes. The contents of the tank were continuously agitated at 70°C and after a further 500 minutes a sample was taken for analysis. At a hydrochloric acid concentration of 7.5 g/L, 98.3% of the iron and 4.9% of the nickel had been dissolved, representing a leaching selectivity of approximately 20, and the leached solids contained 1.6% iron. This example demonstrates substantially complete iron dissolution and high leaching selectivity.

EXAMPLE 4

A nickel-bearing sulphide concentrate was subjected to heating in a stream of hydrogen at a temperature of about 670°C. 521 g of the so-activated material, having an analysis of 9.1% nickel, 41.1% iron and 8.9% copper and an average particle size of approximately 44$\mu$, was slurried with water and added, with 12.2N hydrochloric acid solution, to a 1 liter kettle. The contents of the kettle were continuously agitated at 70°C and after 10 hours a sample was removed for analysis. 93% of the iron and 9.1% of the nickel had been dissolved, representing a leaching selectivity of approximately 10.2. This example illustrates that sulphide materials other than mattes may also be selectively leached by the method of the present invention.

EXAMPLE 5

770 grams of calcine resulting from the oxidative roasting of iron, nickel and copper-bearing sulphide concentrates, having an analysis of 9.6% nickel, 41% iron, 6.7% copper and 0,.5% cobalt and a particle size of 100% less than 149$\mu$, were slurried with 11 liters of an aqueous chloride solution produced by the process of Example 1 and analyzing 182 g/L $Fe^{++}$, 23.5 g/L $Ni^{++}$, and 0.65 g/L $Co^{++}$. Hydrogen sulphide was passed through the slurry, which was maintained in an agitated state at a temperature of 90°C, for 5 hours, following which a sample of slurry was removed for analysis. It was found that the solution contained 206 g/L $Fe^{++}$, 20 ppm $Ni^{++}$ and 30 ppm $Co^{++}$ representing precipitation of 99.9% nickel and 95.4% cobalt.

This experiment demonstrates that in the presence of hydrogen sulphide substantially complete precipitation of nickel and cobalt and the replacement of these metals in solution by iron dissolved from the iron oxide calcine is achieved.

EXAMPLE 6

Three tests were carried out; in each test 1000 ml of a chloride leach solution produced by the process of Example 1 and having an analysis of 168 g/L $Fe^{++}$, 37.5 g/L $Ni^{++}$, 1.21 g/L $Co^{++}$ and 7.1 g/L HCl were mixed with 62 g of iron oxide to form a slurry. Hydrogen sulphide was passed through the slurry, which was agitated and maintained at a temperature of 90°C, for 4 hours.

Three different iron oxide products were used.

1. Cyclone dust, having a particular size of 100% less than 53$\mu$, from fluid-bed hydrolysis of iron chloride solution.
2. Product from spray-roasting of iron chloride solution having a particle size of 84% less than 44$\mu$.
3. Fine product from shaft furnace hydrolysis of briquettes of iron chloride crystals, $FeCl_2 \cdot 2H_2O$.

The iron contained in the iron oxide was substantially equal to the stoichiometric equivalent of the nickel, cobalt and free acid contained in the leach solution. After each test a sample was taken for analysis and the results are given in Table 4.

TABLE 4

| Source of Iron Oxide | Final Solution Analysis | | Precipitate Analysis | % Precipitated | |
|---|---|---|---|---|---|
| | ppm Ni | ppm Co | % Fe | Ni | Co |
| Fluid-Bed | 12 | 10 | 2.2 | 99.9 | 99.2 |
| Spray-Roast | 30 | 23 | 2.0 | 99.9 | 99.0 |
| Shaft-Furnace | 50 | 30 | 1.8 | 99.9 | 98.8 |

It can be seen that the precipitation of nickel and cobalt from solution is substantially complete and that a low iron content precipitate is produced.

EXAMPLE 7

The following test demonstrates the application of the purification process of the present invention to sulphate solutions.

1000 ml of a sulphate solution having an analysis of 59.6 g/L $Fe^{++}$, 29.4 g/L $Ni^{++}$ and 0.78 g/L $Co^{++}$ were slurried with 46.5 g of iron oxide from spray-roasting of iron chloride solution, having a screen analysis of 84% less than 44$\mu$. The iron contained in the iron oxide was substantially equal to the stoichiometric equivalent of the nickel and cobalt contained in the leach solution. Hydrogen sulphide was passed through the slurry, which was agitated and maintained at a temperature of 90°C, for 4 hours, following which a sample was removed for analysis.

The solution contained only 17 ppm nickel and 1 ppm cobalt, representing precipitation of 99.9% nickel and 99.9% cobalt.

EXAMPLE 8

1000 ml of a chloride solution having an analysis of 130 g/L $Fe^{++}$, 1.82 g/L $Ni^{++}$, 0.9 g/L $Co^{++}$, 0.19 g/L $Pb^{++}$, and 4 g/L HCl were agitated at 50°C and treated with 21 ml of $NH_4OH$ (specific gravity 0.9) to generate a white ferrous hydroxide precipitate. Hydrogen sulphide was then passed through the solution for a period of 10 minutes and a sample removed for analysis; results are given in Table 5.

TABLE 5

| Final Solution Analysis | | | % Precipitated | | |
|---|---|---|---|---|---|
| ppm Ni | ppm Co | ppm Pb | Ni | Co | Pb |
| 10 | 22 | 5 | 99 | 97 | 98 |

The above experiment demonstrates the high speed and efficiency of sulphide precipitation by this method.

We claim:

1. In a process for precipitating non-ferrous metals selected from the group consisting of nickel, cobalt and lead as sulphides from mineral aqueous acidic solution, at atmospheric pressure and at temperatures below the boiling point of the solution, in the presence of hydrogen sulphide and a neutralizing agent, the improvement comprising introducing to the solution a particulate iron-bearing substance containing iron oxides, hydroxides, or combinations thereof as the neutralizing agent wherein the iron content is substantially stoichiometrically equivalent to the non-ferrous metals which are to be precipitated and dissolving substantially all of said iron from said iron-bearing substance by reaction with the free acid present in the aqueous solution and that free acid generated during precipitation of non-ferrous metals therefrom.

2. The process according to claim 1 in which the acidic aqueous solution is a chloride solution containing at least 100 g/L dissolved iron.

3. A process according to claim 2 in which the iron-bearing material is produced by the hydrolysis of iron chloride.

4. A process according to claim 2 in which the iron-bearing material is a calcine produced by the oxidative roasting of an iron-bearing sulphide material.

5. A process according to claim 2 in which the iron-bearing material is ferrous hydroxide.

6. A process according to claim 5 in which the acidic aqueous solution contains more dissolved iron than that equivalent to the combined amounts of non-ferrous metals to be precipitated and the ferrous hydroxide is generated within the aqueous solution from the iron dissolved therein by treatment with ammonium hydroxide.

7. A process as claimed in claim 1 wherein the precipitation is carried out at a temperature between 50°C and the boiling point of the solution.

* * * * *